US007560672B2

(12) United States Patent
Pleschinger et al.

(10) Patent No.: US 7,560,672 B2
(45) Date of Patent: Jul. 14, 2009

(54) HEATED PUMP WITH BOILING PROTECTION

(75) Inventors: Andreas Pleschinger, Anthering (AT); Gernot Teufl, Hallein (AT)

(73) Assignee: Bleckmann GmbH & Co. KG (AT)

( * ) Notice: Subject to any disclaimer, the term of this patent is extended or adjusted under 35 U.S.C. 154(b) by 347 days.

(21) Appl. No.: 11/379,072

(22) Filed: Apr. 18, 2006

(65) Prior Publication Data

US 2006/0236999 A1 Oct. 26, 2006

(30) Foreign Application Priority Data

Apr. 21, 2005 (DE) ..... 10 2005 018 597

(51) Int. Cl.
*H05B 3/34* (2006.01)
*A47J 27/00* (2006.01)

(52) U.S. Cl. ..... 219/545; 219/523; 219/437; 392/498; 392/499; 392/500; 392/501; 392/449; 392/450; 392/451; 392/452; 392/453; 392/454; 392/455; 392/456; 392/457; 392/485; 392/487; 337/380; 126/373.1

(58) Field of Classification Search ..... 219/523, 219/437, 545; 392/497–501, 449–457, 485, 392/487, 489, 455; 337/380; 126/373
See application file for complete search history.

(56) References Cited

U.S. PATENT DOCUMENTS 5,459,812 A 10/1995 Taylor

FOREIGN PATENT DOCUMENTS

| | | | |
|---|---|---|---|
| DE | 101 31 995 A1 | | 11/2002 |
| EP | 1 233 649 A1 | | 8/1992 |
| EP | 123649 | * | 8/1992 |
| GB | 2 359 978 A | | 9/2001 |
| WO | 92/05675 A1 | | 4/1992 |
| WO | 99/48331 A | | 9/1999 |
| WO | 01/78566 A | | 10/2001 |

OTHER PUBLICATIONS

EP 06 00 7618 Search Report dated Mar. 30, 2009.

* cited by examiner

*Primary Examiner*—Shawntina Fuqua
(74) *Attorney, Agent, or Firm*—Hahn Loeser & Parks LLP; Michael H. Minns

(57) ABSTRACT

A heating system for heating fluid media including a carrier unit, a heating unit arranged on the carrier unit and a heat transfer element arranged on the carrier unit and includes a material which is a good conductor of heat, which heat transfer element has a first mounting portion for mounting a first safety device which responds at a first response temperature and a second mounting portion for mounting a second safety device which responds at a second response temperature which is lower than the first response temperature, which heat transfer element has a first temperature pickup portion which is in direct heat-conducting contact with the heating unit and the first safety device. The heat transfer element has a second temperature pickup portion is spatially separate from the first temperature pickup portion and in heat-conducting contact with the medium to be heated and the second safety device.

26 Claims, 4 Drawing Sheets

HEATED PUMP WITH BOILING PROTECTION

CROSS-REFERENCE TO RELATED APPLICATIONS

This application claims the benefit of German priority application DE 10 2005 018 597 of the same inventors, filed Apr. 21, 2005.

TECHNICAL FIELD

The present invention concerns a heating system for heating fluid media, in particular a heating system for domestic appliances. In addition the present invention concerns a heat transfer element for a heating.

BACKGROUND OF THE INVENTION

In the case of a large number of domestic appliances or domestic machines, it is necessary to heat up a fluid medium, such as for example water, and that can be effected by means of one or more heating systems. In that case, a medium circuit can be provided, a pump arranged in the circuit causing circulation of the medium in the circuit.

Basic aspects for such a heating system are that, like all other components of the medium circuit, the system is to take up only a small amount of space and is to be inexpensive to produce. Furthermore the heating system is to be simple to assemble. In addition reliable safeguarding of the heating system must be guaranteed upon the occurrence of a critical operating condition which can result in plastic components within the domestic appliance melting or catching fire. In the case of some domestic appliances moreover it may be necessary to prevent the medium to be heated from basically exceeding a predetermined temperature, for example in the case of a dishwashing machine the boiling temperature of the washing water.

For instance, international application WO 92/05675 discloses a heating system in which an elongate heat transfer plate of copper is in heat-conducting contact at its one end with a tubular heater which projects into a tub of a laundry washing machine. The other end of the heat transfer plate is passed through a fixing flange to the outside of the tub. That end is divided into two portions of which one is in contact with an actuating device for a heat-sensitive control, whereas the other portion is connected to a thermal protection device.

SUMMARY OF THE INVENTION

At least one advantage over the prior art is provided by a heating system for heating fluid media, in particular for domestic appliances, comprising: a carrier unit, a heating unit arranged on the carrier unit, and a heat transfer element comprising a material which is a good conductor of heat, wherein the heat transfer element has a first mounting portion for mounting a first safety device which responds at a first response temperature and a second mounting portion for mounting a second safety device which responds at a second response temperature which is lower than the first response temperature, wherein the heat transfer element has a first temperature pickup portion which is in direct heat-conducting contact with the heating unit and the first safety device, wherein the heat transfer element has a second temperature pickup portion which is spatially separate from the first temperature pickup portion and which is in heat-conducting contact with the medium to be heated and the second safety device; and wherein the first temperature pickup portion of the heat transfer element is in direct heat-conducting contact with an underside with the heating unit and the first safety device is arranged on a top side of the heat transfer element at the first mounting portion so that the heat transfer element is arranged between the first safety device and the heating unit.

In one embodiment present invention may provide a heating system and a heat transfer element for such a heating system, which while being of a compact structure permit the provision of two different safeguard means in a simple and inexpensive manner. In one embodiment of the invention flange through-ducting arrangements and effecting expensive and complicated steps for sealing integrity are avoided.

The provision of a second temperature pickup portion at the heat transfer element which is spatially separate from the first temperature pickup portion and which is in heat-conducting contact with the medium to be heated as well as the second safety device permits both the temperature of the heating unit and also the temperature of the medium to be heated to be monitored with one and the same heat transfer element. That can ensure that in an emergency disaster scenario, that is to say the heating unit operates without the cooling effect of the medium to be heated (running dry), the power supply for the heating unit is switched off by the first safety device. That switch-off action takes place prior to the reaction on the part of the second safety device as the first safety device is in direct heat-conducting contact with the heating unit by way of the heat transfer element so that the considerable rise in temperature in the heating unit as a consequence of the non-existent cooling action by the medium to be heated is detected directly by the first safety device. In comparison the second safety device can detect for example boiling of the medium to be heated as that second safety device is in heat-conducting contact with the medium to be heated, by way of the second temperature pickup portion. It is to be noted in that respect that both the first safety device and also the second safety device are arranged jointly on the heat-transfer element. In that way therefore two safety functionalities can be combined in a very small structural space with a single heat transfer element in a simple and inexpensive manner.

In a certain embodiment, the first temperature pickup portion of the heat transfer element is in direct heat-conducting contact with an underside with the heating unit and the first safety device is arranged on a top side of the heat transfer element at the first mounting portion so that the heat transfer element is arranged between the first safety device and the heating unit.

Further, the first temperature pickup portion may be with the underside in direct heat-conducting contact approximately in full area relationship with a surface of the heating unit. Furthermore, the first temperature pickup portion may be with the underside is in direct heat-conducting contact with the surface of the heating unit in such a way that the heating unit is arranged substantially between the first temperature pickup portion and the carrier unit.

The above-discussed advantage can be still further enhanced if the second temperature pickup portion and the second mounting portion for the second safety device are separated from a direct or immediate heat-conducting contact in relation to the heating unit. That can be effected for example by the second mounting portion and the second pickup portion being provided in spaced relationship with the heating unit so that a medium which is a poor conductor of heat such as air can be provided between the heating unit and at least the second mounting portion for the second safety device.

In order to achieve more reliable detection of the temperature of the medium to be heated, the second temperature pickup portion of the heat transfer element may be in direct heat-conducting contact with the carrier unit in a region of the carrier unit which in normal operation of the heating system has the medium to be heated flowing therearound.

In a certain embodiment, using one and the same heat-conducting transfer element for the first safety device and the second safety device makes it possible for the second mounting portion for the second safety device as well as the second temperature pickup portion to be arranged separately from the heating unit. That separation effect can be achieved for example by the first and the second mounting portions for the first and the second safety devices being arranged in planes which extend in parallel relationship with each other and which are spaced in a direction in space extending at least approximately perpendicularly to the two planes of the mounting portions and which are connected together by way of a connecting portion. In that arrangement the connecting portion may include an angle within the range >0° and <90° with the two planes for the two mounting portions.

In a further development, in order to promote a more compact structure for the heating system according to the invention, it can further be provided that the first temperature pickup portion is arranged in the plane of the first mounting portion.

In comparison the second temperature pickup portion can be arranged in a plane which extends at least approximately parallel to the plane of the second mounting portion, but is arranged in spaced relationship with the plane of the second mounting portion in a direction in space extending at least approximately perpendicularly to the plane of the second mounting portion. Alternatively it can be provided that the second temperature pickup portion is arranged in a plane which includes an angle of between 0° and 90° with the plane of the second mounting portion.

In order to be able to mount the heat transfer element to the carrier unit, it can further be provided that the heat transfer element has at least a first and a second assembly portion for mounting the element to the carrier unit. It will be appreciated that still further assembly portions can also be provided on the heat transfer element.

The first and the second assembly portions of the heat transfer element can be disposed at least approximately in the same plane in which the first mounting portion and the first temperature pickup portion are arranged. In addition the first and the second assembly portions of the heat transfer element can be provided at mutually opposite ends of the heat transfer element. In conjunction with the spaced arrangement of the second mounting portion for the second safety device and the provision of the at least two assembly portions at the ends of the heat transfer element in the same plane as the first mounting portion and the first temperature pickup portion, there is the possibility of the heat transfer element being in the form of a bridge. In that case the second mounting portion forms the bridge arch which spans over the heating unit without being in contact therewith.

Basically any desired shape can be used for the heat transfer element. In one embodiment a space-saving arrangement is promoted if the heat transfer element is an elongate flat element. In that respect, in respect of the thickness of the element, it is to be noted basically and separately from the foregoing description that the thickness of the heat transfer element must be so selected that the heat to be transferred from the heating unit by way of the first temperature pickup portion to the first safety device and from the medium to be heated by way of the second temperature pickup portion to the second safety device must go to the respective safety device quickly and without a time delay.

Once again any desired shape can be provided for the carrier unit. In connection with dishwashing machines it has proven to be advantageous if the carrier unit is a disc so that it can be arranged in the direct proximity of the pump for conveying the washing water.

In order to be able to mount the heating unit to the carrier unit, it is further advantageous if the carrier unit has a recess which is open at one side and which is preferably at least approximately C-shaped in cross-section for receiving the heating unit. In that respect the heat transfer element can be at least partially arranged at the open side of the recess so that it is in direct heat-conducting contact with the heating unit in the region of the first temperature pickup portion whereas it is spaced in relation to the heating unit in the region of the second temperature pickup portion.

Any desired and suitable shape can be adopted for the heating unit. In a certain embodiment, it is preferred for the heating unit to be formed by at least one tubular heater.

Further, in order to provide for good heat transfer from the heating unit to the medium to be heated by way of the carrier unit, it can further be provided that the cross-sectional shape of the heating unit is at least approximately adapted to the cross-sectional shape of the recess of the carrier unit.

The heat transfer element according to the invention comprises material which is a good conductor of heat and has at least a first and a second mounting portion for at least a first and a second safety device as well as a first temperature pickup portion for detecting the temperature of an object to be monitored by the first safety device. In addition there is provided a second temperature pickup portion which is spatially separated from the first temperature pickup portion for detecting the temperature of an object to be monitored by the second safety device.

It can further be provided that the first and the second mounting portions of the heat transfer element for the first and the second safety devices are arranged in planes which extend in mutually parallel relationship and which are spaced in a direction in space extending at least approximately perpendicularly to the two planes of the mounting portions, and which are connected together by way of a connecting portion.

In that respect the first temperature pickup portion can be arranged in the plane of the first mounting portion and/or the second temperature pickup portion can be arranged in a plane which is parallel to the plane of the second mounting portion but spaced in relation thereto in a direction in space extending at least approximately perpendicularly to the plane of the second mounting portion.

Alternatively the second temperature pickup portion can be arranged in a plane which includes an angle of between 0° and 90° with the plane of the second mounting portion.

The heat transfer element can also have at least a first and a second assembly portion for mounting the heat transfer element to the carrier unit.

The first and the second assembly portions of the heat transfer element can be disposed at least approximately in the same plane in which the first mounting portion and the first temperature pickup portion are arranged. In addition the first and the second assembly portions of the heat transfer element can be provided at mutually opposite ends of the heat transfer element. Moreover the heat transfer element can be an elongate flat element.

BRIEF DESCRIPTION OF THE DRAWINGS

Further advantageous configurations and an embodiment by way of example of the present invention are described hereinafter with reference to the accompanying drawings. In this connection it is to be noted that the terms 'left', 'right', 'bottom' and 'top' used during the description of the specific embodiment relate to the Figures of the drawings with the Figure identifications and the reference numerals in a normally readable position. In the drawings.

DETAILED DESCRIPTION OF THE INVENTION

The heating system according to the invention which is described hereinafter with reference to FIGS. 1 to 5 is in this embodiment a component part of a dishwashing machine (not further shown). It will be appreciated however that the heating system can also be used in relation to any other domestic appliance or any other item of equipment in which warming or heating of a fluid medium is necessary.

Figure 1:
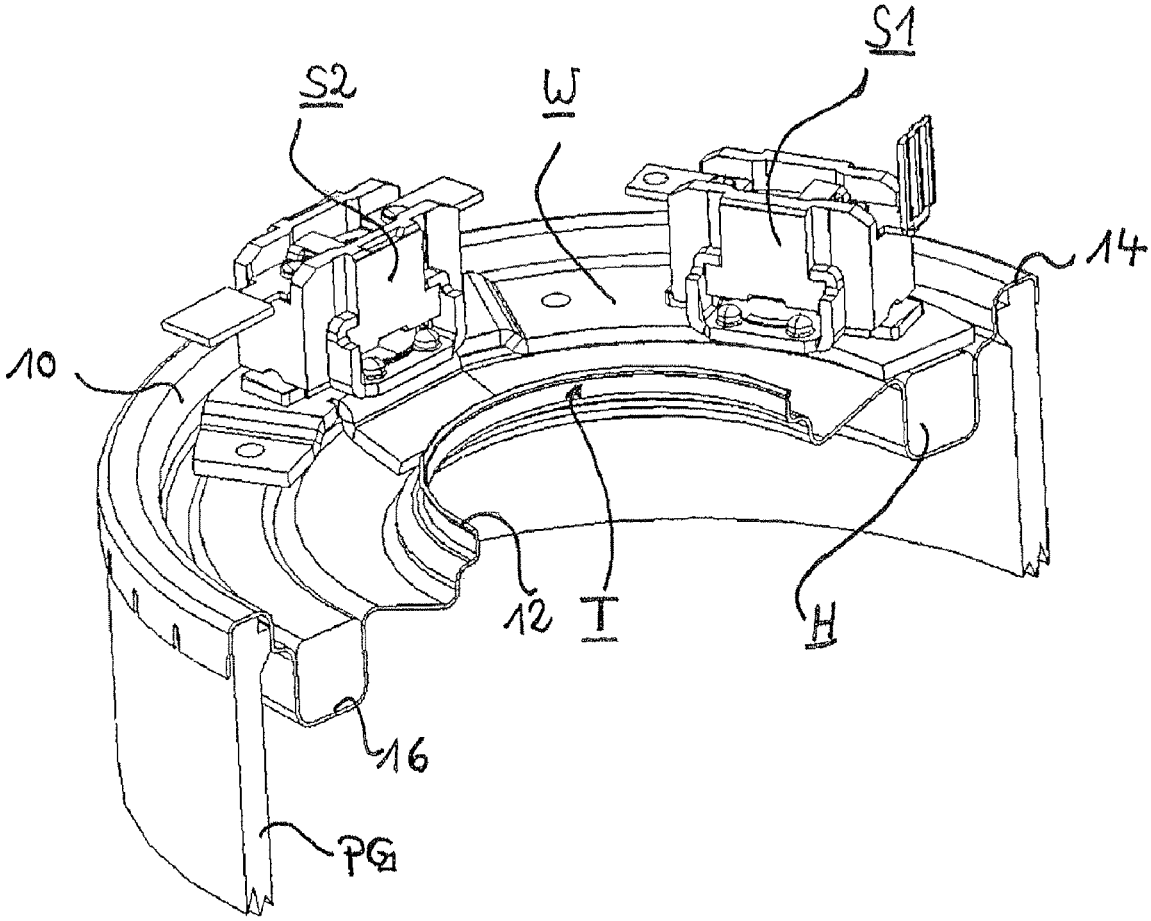
FIG. 1 shows a perspective sectional view of part of the heating system according to the invention.
Figure 2:
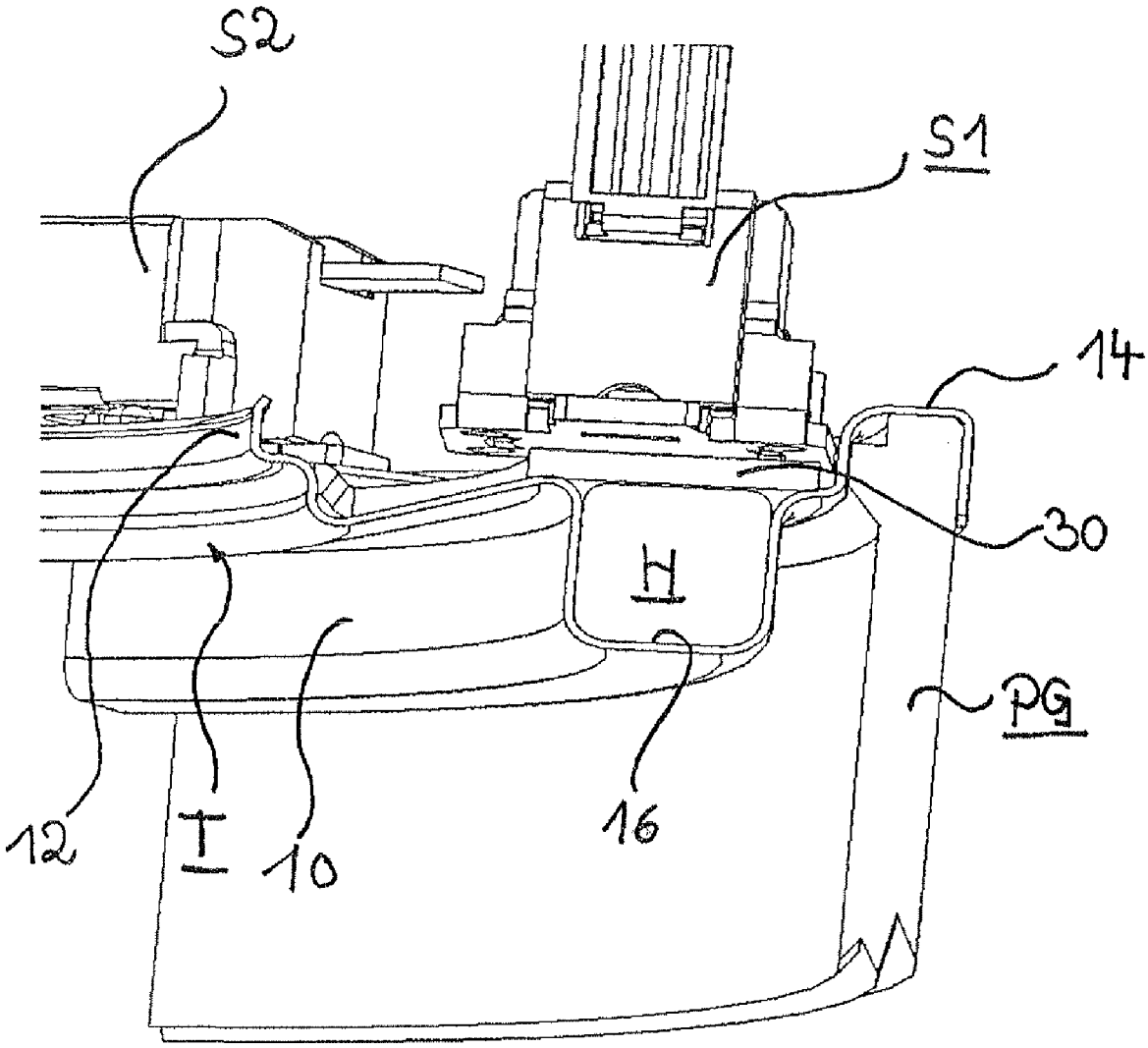
FIG. 2 shows a perspective view on a larger scale than FIG. 1 of the right-hand half of the heating system according to the invention as shown in FIG. 1.
Figure 3:
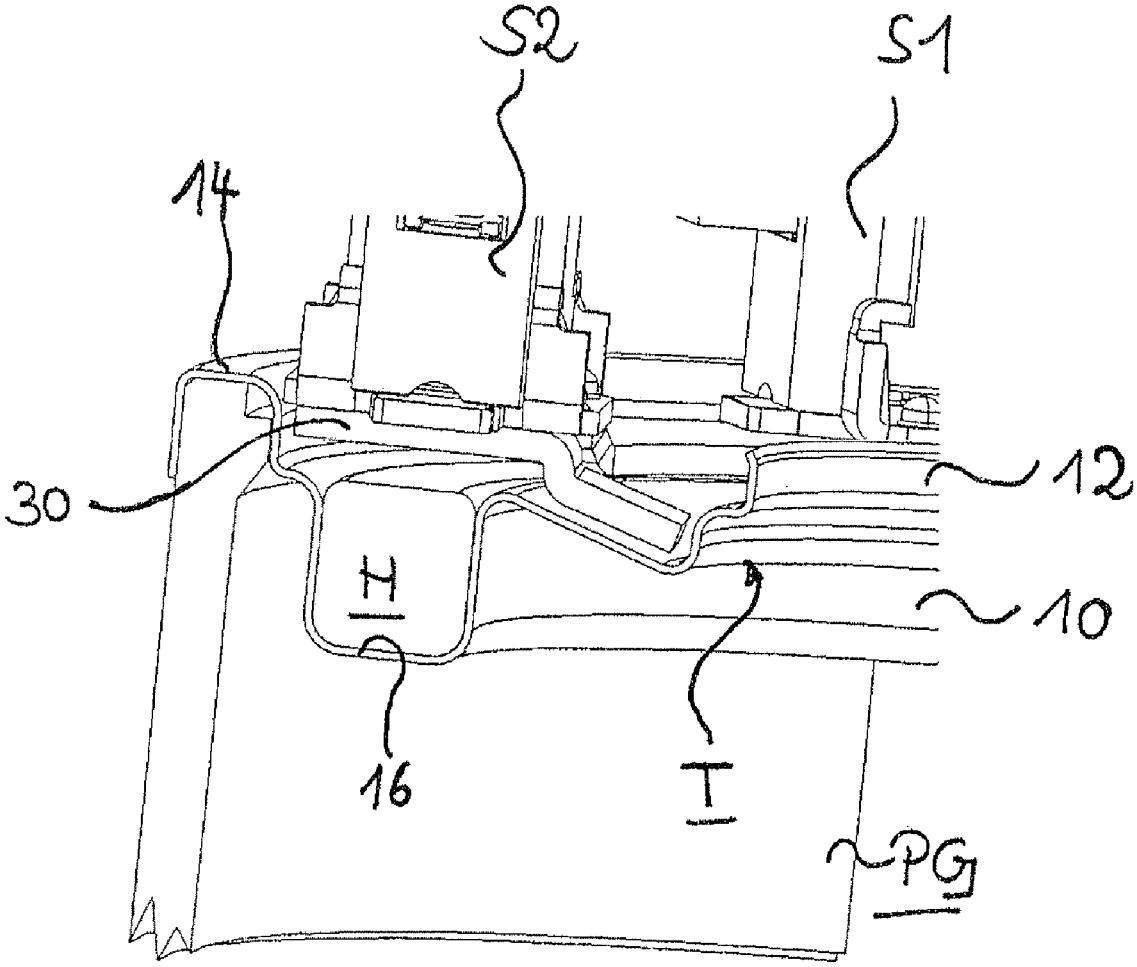
FIG. 3 shows a perspective view on a larger scale than FIG. 1 of the left-hand half of the heating system according to the invention as shown in FIG. 1.

As can be seen from FIG. 1 the heating system according to the invention, as main components, comprises a carrier unit T and a heating unit H. In addition there is a heat transfer element W on which a first safety device S1 and a second safety device S2 are arranged. The first safety device S1 interrupts the power circuit to the heating unit H, in dependence on the temperature of the heating unit H, which is detected by the first safety device. That occurs in particular when the temperature of the heating unit H exceeds a first predetermined temperature limit value, for example when the heating unit H runs dry. In that respect the first predetermined temperature limit value is so set that melting of plastic parts in the region of the heating system is avoided. In comparison the second safety device S2 interrupts the power circuit to the heating unit H in dependence on the temperature of the medium to be heated, which is detected by the second safety device. That occurs in particular when the temperature of the medium to be heated exceeds a second predetermined temperature limit value which can be defined for example by the boiling temperature of the medium to be heated. That is intended to prevent the medium from boiling.

The heating system is connected to a conveyor pump of the dishwashing machine, of which only the housing PG comprising a plastic material with a low melting point is shown in part. The heating system can be mounted to the conveyor pump or the housing PG thereof during assembly of the domestic appliance or can form a pre-assembled structural unit together with the conveyor pump.

As can be seen from FIGS. 1 to 4 the carrier unit T is a circular disc 10 which is produced from corrosion-resistant steel. In concentric relationship with its central axis (not shown) the disc 10 has a circular hole 12, through which the suction pipe of the pump is passed in sealing integrity in relation to the medium. At its outer peripheral edge 14 the disc 10 also engages over the edge of the pump housing PG in sealing integrity in relation to the medium. That side of the disc 10, which faces in the direction of the lower edge of the sheet in FIG. 1, is in direct contact with the medium to be heated in the installed condition of the pump and can therefore be referred to as the wet side whereas the side of the disc 10, which faces towards the upper edge of the sheet, does not come into contact with the medium and can thus be referred to as the dry side.

As can further be seen from FIG. 1 the disc 10 forming the carrier unit T has a recess 16 which extends therearound in concentric relationship with its central axis at approximately the radial centre of the disc 10. The recess 16 is of a square configuration in cross-section, wherein one side of the square, being the upwardly facing side, is omitted. The heating unit H which is formed by a tubular heater of known kind is fitted in the recess 16. As can be seen from FIG. 1 the shape and the outside dimensions of the heating unit H are matched to the shape and the outside dimensions of the recess 16 in the disc 10 in such a way that the heating unit A bears in full area contact at three sides against the inside walls (not identified in greater detail) of the recess 16. That provides that the heat produced by the heating unit H is transmitted to the medium which is disposed on the wet side of the disc 10 and which is to be heated.

Figure 5:
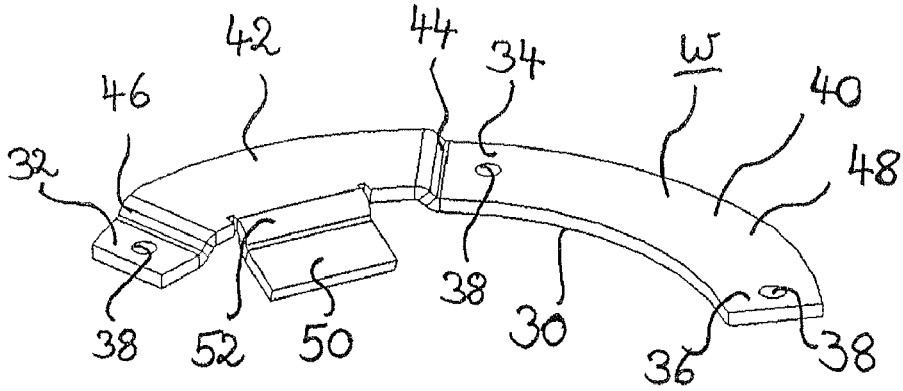
FIG. 5 shows a perspective view of a heat transfer element according to the invention.
Figure 4:
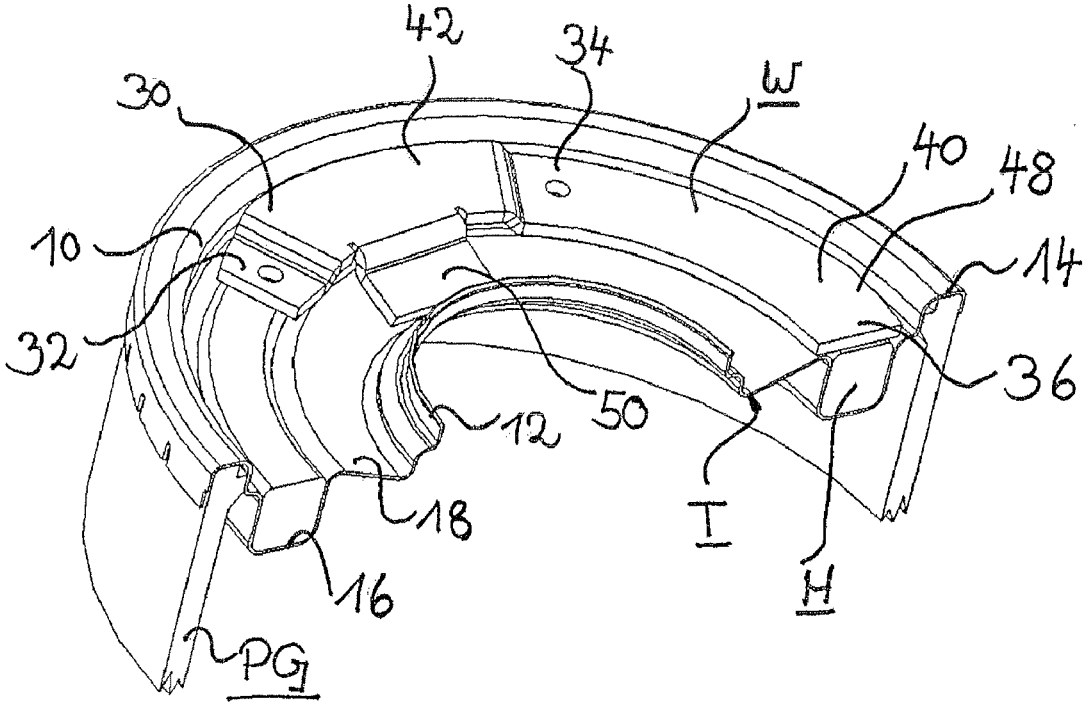
FIG. 4 shows a perspective sectional view of part of the heating system according to the invention without safety devices.

As can be seen from FIGS. 4 and 5 the heat transfer element W is formed by a circular segment-like flat strip 30 comprising a material which is a good conductor of heat such as preferably aluminium. The radius of the centre line (not shown) of the flat strip 30 corresponds at least approximately to the radius of the centre line of the recess 16 so that the flat strip 30 follows the curvature of the recess 16 of the disc 10 and thus the curvature of the heating unit H.

The flat strip 30 of the heat transfer element W has a plurality of portions which are integrally connected together. Thus there are firstly provided three assembly portions 32, 34 and 36 which are all arranged in one plane. The assembly portions 32, 34 and 36 each have a through aperture 38 for receiving fixing elements for the temperature safety devices. The heat transfer element W or the flat strip 30 is preferably fixed by welding to the disc 10 of the carrier unit T.

In addition the flat element 30 of the heat transfer element W has a first mounting portion 40 and a second mounting portion 42 for the first safety device S1 and the second safety device S2. As is also readily apparent from FIGS. 4 and 5 the first mounting portion 40 and the second mounting portion 42 are each arranged in respective planes which extend in mutually parallel relationship but which are arranged spaced relative to each other in a direction in space extending substantially perpendicularly to the two planes. The two mounting portions 40, 42 are connected together by way of a connecting portion 44. In addition the left-hand assembly portion 32 is connected by way of a further connecting portion 46 to the mounting portion 42 for the second safety device S2. By virtue of the plane-displaced arrangement of the second mounting portion 42 with respect to the first mounting portion 40, the second mounting portion 42, together with the two connecting portions 44, 46 and the assembly portions 32, 34 which directly adjoin those two connecting portions 44, 46, form a bridge, on the apex of which, being the second mounting portion 42, the second safety device S2 is arranged. By virtue of that 'bridge structure', the second mounting portion 42 and therewith the second safety device S2 are arranged spaced from the heating unit H and accordingly are not in direct heat-conducting relationship with the heating unit H. In other words, the second safety device S2 is decoupled from the heating unit H.

The mounting portion 40 for the first safety device S1 also forms at the same time a first temperature pickup portion 48. That first temperature pickup portion 48 is in direct heat-conducting contact with the heating unit H, as can be seen from FIG. 4, so that the temperature of the heating unit H can be detected in that way. That direct heat-conducting contact is afforded by virtue of the fact that the underside of the flat element 30 or the heat transfer element W, in the region of the first temperature pickup portion 48, bears at least approximately in full area contact against the top side of the heating unit H. By virtue of that configuration, the temperature produced by the heating unit H can be transmitted by way of the first temperature pickup portion 48 to the first safety device S1 which is arranged on the top side of the flat strip 30 at least approximately in the region of the first temperature pickup portion 48 at the first mounting portion 40 (see FIG. 1).

In comparison the second mounting portion 42 for the second safety device S2 is spaced from the heating unit H, as has already been described hereinbefore. In order to be able reliably to pick up the temperature of the medium to be heated, there is provided a second temperature pickup portion 50 which is in the form of a tongue 50 extending radially inwardly with respect to the curvature of the heat transfer element W or the flat strip 30. As can be seen in particular from FIG. 5 the plane of the tongue 50 includes an angle of between >0° and <90° with the plane of the second mounting portion 52. Furthermore the tongue 50 is connected to the second mounting portion 42 by way of a connecting portion 52.

The tongue 50 forming the second temperature pickup portion bears at least approximately in full area contact directly against a region 18 of the disc 10 of the carrier unit T. The region 18 is in the form of a circular ring relative to the central axis of the disc 10 in such a way that it directly adjoins the through hole 12 in the disc 10, in the direction of the outside of the disc 10. In addition the region 18 of the disc 10 includes an angle of between >0° and <90° with the horizontal.

As the first predetermined temperature limit value which is monitored by the first safety device S1 and which in the present embodiment is attained only when the heating system runs dry is greater than the second predetermined temperature limit value which is monitored by the second safety device S2 and which in the present embodiment is intended to prevent boiling of the medium to be heated, the second safety device S2 triggers prior to the first safety device S1 when a medium to be heated is present, as the boiling temperature of the medium is usually lower than the temperature of the heating unit H which, in the case of running dry, results in the plastic parts of the domestic appliance melting. In comparison the first temperature limit value at the first temperature pickup portion 48 is reached more quickly in the case of the system running dry than the second temperature limit value at the second temperature pickup portion 50 as the latter is arranged further away from the heating unit H than the first temperature pickup portion 48 which is in direct heat-conducting contact with the heating unit H and as the temperature of the heating unit H rises very quickly in the case of the system running dry.

While there have been shown and described and pointed out fundamental features of the invention as applied to the preferred embodiments thereof, it will be understood that various omissions and substitutions and changes in the form and details of the devices and methods described may be made by those skilled in the art without departing from the present invention. For example, it is expressly intended that all combinations of those elements, which perform substantially the same function in substantially the same way to achieve the same results, are within the scope of the invention. Moreover, it should be recognized that structures and/or elements and/or described in connection with any disclosed form or embodiment of the invention may be incorporated in any other disclosed or described or suggested form or embodiment as a general matter of designed choice. It is the intention, therefore, to be limited only as indicated by the scope of the claims appended hereto.

Finally but yet importantly, it is noted that the term "comprises" or "comprising" when used in the specification including the claims is intended to specify the presence of stated features, means, steps or components, but does not exclude the presence or addition of one or more other features, means, steps, components or group thereof. Further, the word "a" or "an" preceding an element in a claim does not exclude the presence of a plurality of such elements. Moreover, any reference sign does not limit the scope of the claims.

We claim:

1. A heating system for heating fluid media, in particular for domestic appliances, comprising:

a carrier unit, a heating unit arranged on the carrier unit, and a heat transfer element comprising a material which is a good conductor of heat, wherein the heat transfer element has a first mounting portion for mounting a first safety device which responds at a first response temperature and a second mounting portion for mounting a second safety device which responds at a second response temperature which is lower than the first response temperature, wherein the heat transfer element has a first temperature pickup portion which is in direct heat conducting contact with the heating unit and the first safety device, wherein the heat transfer element has a second temperature pickup portion which is spatially separate from the first temperature pickup portion and which is in heat-conducting contact with the medium to be heated and the second safety device; and wherein the first temperature pickup portion of the heat transfer element is in direct heat-conducting contact with an underside with the heating unit and the first safety device is arranged on a top side of the heat transfer element at the first mounting portion so that the heat transfer element is arranged between the first safety device and the heating unit, wherein the second temperature pickup portion of the heat transfer element is in direct heat-conducting contact with the carrier unit in a region of the carrier unit which in normal operation of the heating system has the medium to be heated flowing therearound.

2. The heating system according to claim 1, wherein the first temperature pickup portion with the underside is in direct heat-conducting contact approximately in full area relationship with a surface of the heating unit.

3. A heating system for heating fluid media, in particular for domestic appliances, comprising:

a carrier unit, a heating unit arranged on the carrier unit, and a heat transfer element comprising a material which is a good conductor of heat, wherein the heat transfer element has a first mounting portion for mounting a first safety device which responds at a first response temperature and a second mounting portion for mounting a second safety device which responds at a second response temperature which is lower than the first response temperature, wherein the heat transfer element has a first temperature pickup portion which is in direct heat-conducting contact with the heating unit and the first safety device, wherein the heat transfer element has a second temperature pickup portion which is spatially separate from the first temperature pickup portion and which is in heat-conducting contact with the medium to be heated and the second safety device; and wherein the first temperature pickup portion of the heat transfer element is in direct heat-conducting contact with an underside with the heating unit and the first safety device is arranged on a top side of the heat transfer element at the first mounting portion so that the heat transfer element is arranged between the first safety device and the heating unit, wherein the first temperature pickup portion with the underside is in direct heat-conducting contact with the surface of the heating unit in such a way that the heating unit is arranged substantially between the first temperature pickup portion and the carrier unit.

4. The heating system according to claim 1, wherein the first safety device is arranged on the top side of the heat transfer element at the first mounting portion in the region of the first temperature pickup portion.

5. The heating system according to claim 1, wherein the second temperature pickup portion and the second mounting portion for the second safety device are separated from direct heat-conducting contact in relation to the heating unit.

6. A heating system for heating fluid media, in particular for domestic appliances, comprising:

a carrier unit, a heating unit arranged on the carrier unit, and a heat transfer element comprising a material which is a good conductor of heat, wherein the heat transfer element has a first mounting portion for mounting a first safety device which responds at a first response temperature and a second mounting portion for mounting a second safety device which responds at a second response temperature which is lower than the first response temperature, wherein the heat transfer element has a first temperature pickup portion which is in direct heat-conducting contact with the heating unit and the first safety device, wherein the heat transfer element has a second temperature pickup portion which is spatially separate from the first temperature pickup portion and which is in heat-conducting contact with the medium to be heated and the second safety device; and wherein the first temperature pickup portion of the heat transfer element is in direct heat-conducting contact with an underside with the heating unit and the first safety device is arranged on a top side of the heat transfer element at the first mounting portion so that the heat transfer element is arranged between the first safety device and the heating unit, wherein the first and the second mounting portions for the first and the second safety devices are arranged in planes which extend in mutually parallel relationship and which are spaced in a direction extending at least approximately perpendicularly to the two planes of the mounting portions and which are connected together by way of a connecting portion.

7. The heating system according to claim 6 wherein the first temperature pickup portion is arranged in the plane of the first mounting portion.

8. The heating system according to claim 6 wherein the second temperature pickup portion is arranged in a plane which extends in at least approximately parallel relationship with the plane of the second mounting portion but is arranged in spaced relationship with the plane of the second mounting portion in a direction in space extending at least approximately perpendicularly to the plane of the second mounting portion.

9. The heating system according to claim 6 wherein the second temperature pickup portion is arranged in a plane which includes an angle of between 0° and 90° with the plane of the second mounting portion.

10. The heating system according to claim 1 wherein the heat transfer element has at least a first and a second assembly portion for mounting the heat transfer element to the carrier unit.

11. The heating system according to claim 10, wherein the first and the second assembly portions of the heat transfer element are disposed at least approximately in the same plane in which the first mounting portion and the first temperature pickup portion are arranged.

12. The heating system according to claim 10, wherein the first and the second assembly portions of the heat transfer element are provided at mutually opposite ends of the heat transfer element.

13. The heating system according to claim 1, wherein the heat transfer element is an elongate flat element.

14. The heating system according to claim 1, wherein the carrier unit is a disc.

15. The heating system according to claim 1, wherein the carrier unit has a recess which is open at one side and which is preferably at least approximately C-shaped in cross-section for receiving the heating unit.

16. The heating system according to claim 15, wherein the heat transfer element is arranged at least partially at the open side of the recess, wherein it is in direct heat-conducting contact with the heating unit in the region of the first temperature pickup portion whereas it is spaced in relation to the heating unit in the region of the second temperature pickup portion.

17. The heating system according to claim 1, wherein the heating unit is formed by at least one tubular heater.

18. The heating system according to claim 15, wherein the cross-sectional shape of the heating unit is at least approximately adapted to the cross-sectional shape of the recess of the carrier unit.

19. A heat transfer element for a heating system, the heat transfer element comprises:

a material which is a good conductor of heat and has at least a first and a second mounting portion for at least a first and a second safety device as well as a first temperature pickup portion for detecting the temperature of an object to be monitored by the first safety device, wherein the heat transfer element has a second temperature pickup portion which is spatially separate from the first temperature pickup portion, for detecting the temperature of an object to be monitored by the second safety device; and wherein the first and the second mounting portions for the first and the second safety devices are arranged in planes which extend in mutually parallel relationship and which are spaced in a direction in space which extends at least approximately perpendicularly to the two planes of the mounting portions, wherein the planes are connected together by way of a connecting portion.

20. The heat transfer element according to claim 19, wherein the first temperature pickup portion is arranged in the plane of the first mounting portion.

21. The heat transfer element according to claim 19, wherein the second temperature pickup portion is arranged in a plane which extends in parallel relationship with the plane of the second mounting portion but is arranged in spaced relationship with the plane of the second mounting portion in a direction in space extending at least approximately perpendicularly to the plane of the second mounting portion.

22. The heat transfer element according to claim 19, wherein the second temperature pickup portion is arranged in a plane which includes an angle of between 0° and 90° with the plane of the second mounting portion.

23. The heat transfer element according to claim 19, wherein the heat transfer element has at least a first and a second assembly portion for mounting the heat transfer element to a carrier unit.

24. The heat transfer element according to claim 23, wherein the first and the second assembly portions of the heat transfer element are disposed at least approximately in the same plane in which the first mounting portion and the first temperature pickup portion are arranged.

25. The heat transfer element according to claim 23, wherein the first and the second assembly portions of the heat transfer element are provided at mutually opposite ends of the heat transfer element.

26. The heat transfer element according to claim 19, wherein the heat transfer element is an elongate flat element.

* * * * *